United States Patent [19]

Colby

[11] 4,099,273

[45] Jul. 11, 1978

[54] BATHTUB

[76] Inventor: Wenham J. Colby, 35 Hertzler Rd., Newport News, Va. 23602

[21] Appl. No.: 674,975

[22] Filed: Apr. 8, 1976

[51] Int. Cl.[2] ..... A47K 3/06; A61H 33/00

[52] U.S. Cl. ..... 4/173 R

[58] Field of Search ..... 4/173, 176, 178; 5/89, 5/90

[56] References Cited

U.S. PATENT DOCUMENTS

| | | | |
|---|---|---|---|
| 760,540 | 5/1904 | Lancaster | 4/176 |
| 1,338,034 | 4/1920 | Nickels | 4/173 |
| 1,367,896 | 2/1921 | Simpson | 4/176 |
| 1,724,479 | 8/1929 | Havener | 4/176 |
| 2,010,791 | 8/1935 | Sakier | 4/173 |
| 2,576,623 | 11/1951 | McLaughlin | 4/176 |
| 3,559,216 | 2/1971 | Kyte | 4/178 |
| 3,641,596 | 2/1972 | Bill | 4/173 |
| 3,827,087 | 8/1974 | Cuthbertson | 4/178 |
| 3,924,278 | 12/1975 | Ekman | 4/176 |

FOREIGN PATENT DOCUMENTS

| | | | |
|---|---|---|---|
| 634,454 | 2/1962 | Italy | 4/178 |
| 22,624 of | 1891 | United Kingdom | 4/173 |

*Primary Examiner*—Robert I. Smith
*Attorney, Agent, or Firm*—George F. Helfrich

[57] ABSTRACT

A bathtub having improved safety for all people, but more especially the for elderly, or handicapped.

The bathtub has the following essential elements:

(a) A rigid polyhedral support structure having a top, bottom, front, back, and two side faces. The support structure has a channel, the configuration of which is substantially a half circular cylinder, and the channel partially penetrates into the support structure from the intersection of the top and front faces thereof and extends along the length thereof from one side face to the other side face thereof.

(b) A concave, water tight body substantially having the configuration of a half circular cylinder. The body is positioned within the channel so that the cylindrical surface of the body conforms to the cylindrical configuration of the channel, and the cylindrical surface of the body is mounted on the support structure so that the body may rotate about the longitudinal axis thereof.

(c) Releasable locking means for temporarily securing the body in (1) a first position defined by complete congruence of the body and the channel, or (2) a second position defined by parallelism of the plane of the bottom of the support structure with the plane joining the remanent diameters of the half circular cylindrical body.

(d) Means for causing the body to rotate from said first position to said second position.

(e) Means for the addition and removal of water from the body while said second position is occupied.

2 Claims, 6 Drawing Figures

BATHTUB

BACKGROUND OF THE INVENTION

One of the most difficult tasks for an elderly or handicapped person is that of bathing. Employing a typical bathtub in use today, the user must step over a wall of the tube and then sit down in the tub. While this procedure is completely safe for a normal person, it is extremely difficult for the physically limited. In addition, the chance of slipping on the tub bottom while getting in or out is always a danger.

To reduce the dangers inherent in the use of a typical bathtub, the design of the bathtub of the present invention is such that the sides of the tub, and/or the doors of previously designed bathtubs, have been completely eliminated.

SUMMARY OF THE INVENTION

The bathtub assembly of the present invention comprises the combination of:

(a) a rigid, polyhedral support structure having a top, bottom, front, back, and two side faces, the support structure having a channel, the configuration of which is substantially a half a circular cylinder, the channel partially pentrating into the support structure from the intersection of the top and front faces thereof and extending along the length thereof from one side face to the other side face thereof;

(b) a concave, water tight body substantially having the configuration of a half circular cylinder, the body positioned within the channel so that the cylindrical surface of the body conforms to the cylindrical configuration of the channel, the cylindrical surface of the body being mounted on the support structure so that the body may rotate about the longitudinal axis thereof;

(c) releasable locking means for temporarily securing the body in (1) a first position defined by complete congruence of the body and the channel, or (2) a second position defined by parallelism of the plane of the bottom of the support structure with the plane joining the remanent diameters of the half circular cylindrical body;

(d) means for causing the body to rotate from said first position to said second position; and (e) means for the addition and removal of water from the body while said second position is occupied.

Special advantages are achieved when the rotational mounting means for the body is a track bearing secured on the support structure at the bottom of the channel therein.

This bathtub is designed to be simple in construction, economical to manufacture and efficient to use. When this bathtub is in the proper position for the user to make an entry, all the dangers of previously designed tubs having vertical walls, or opening and closing of doors have been completely eliminated.

This bathtub will be a great help, not only for the well, but also for the elderly or handicapped, by eliminating the vertical walls, and if a user is critically ill, attendants could place the user in the tub in a lying down position and operate the tub by a handle and a set of gears on the end of the tub.

BRIEF DESCRIPTION OF THE DRAWINGS

For a more complete understanding of the present invention, including its objects and benefits, reference should be made to the detailed description of the preferred embodiments thereof, which is set forth below. This detailed description should be read together with the accompanying drawing, wherein.

INDEX OF PARTS EMPLOYED

Figure 1:
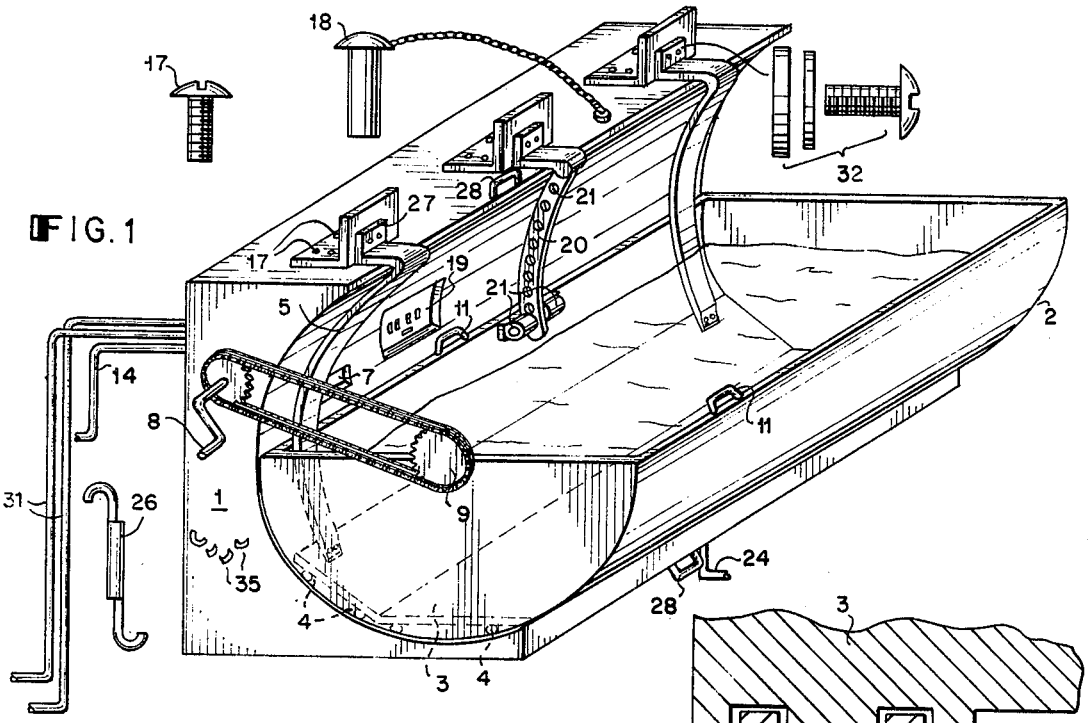
FIG. 1 is a detailed schematic of the invention showing all of the necessary elements for the bathtub to be ready for the user.
Figure 2:
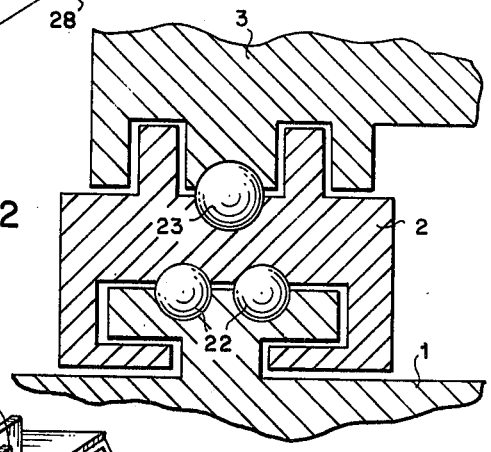
FIG. 2 shows the connection of the floor to the inside of the tub by rotational mounting means such as a track bearing.
Figure 3:
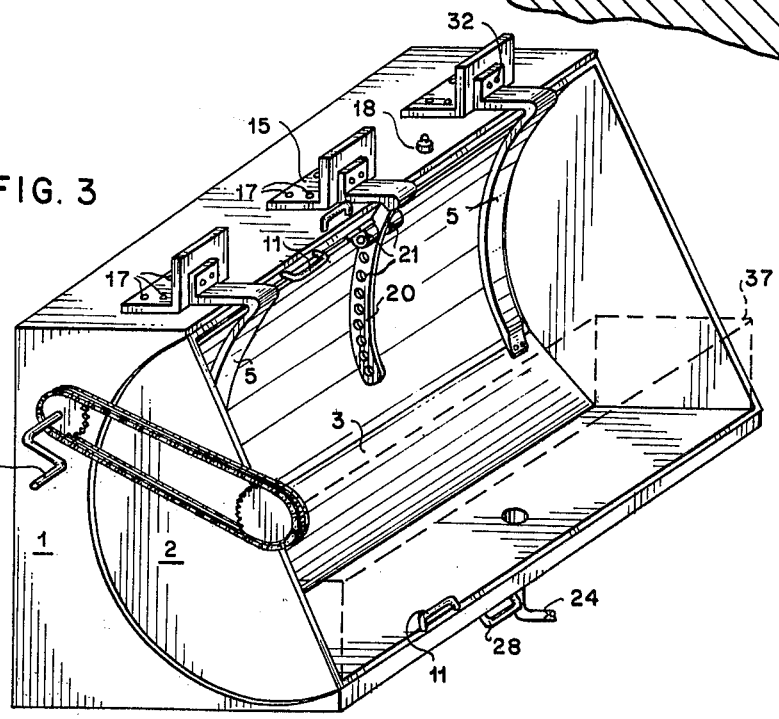
FIG. 3 shows the bathtub in a position ready for the user to enter and also a design to raise the tub floor (dotted lines) if desired.
Figure 5:
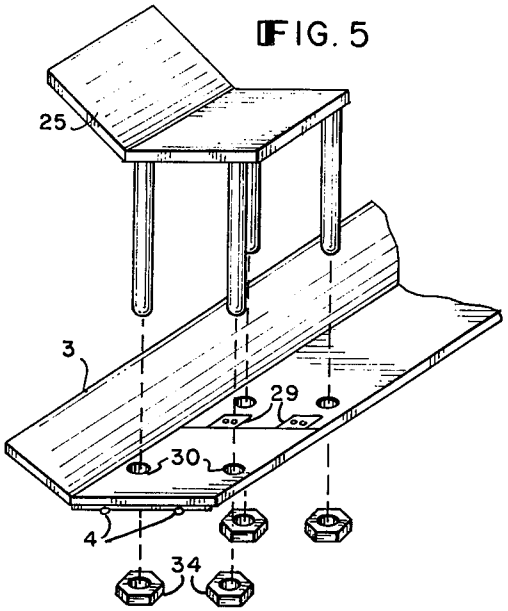
FIG. 5 shows an embodiment of the present invention outfitted with hot and cold water spigots and drainige means.
Figure 4:
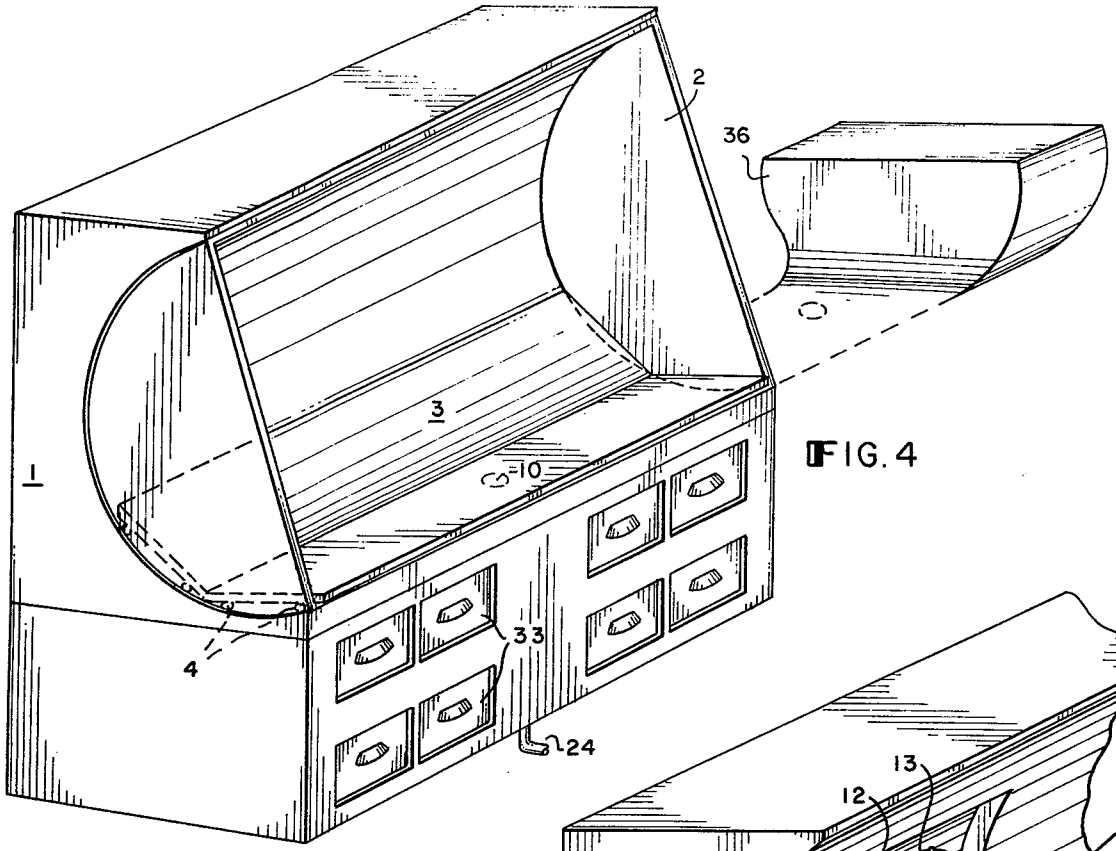
FIG. 4 depicts a bathtub having a support structure which is supplied with drawers for towels, or what have you; it also shows a floor design with one end shaped as a stool or the bottom of a chair.
Figure 6:
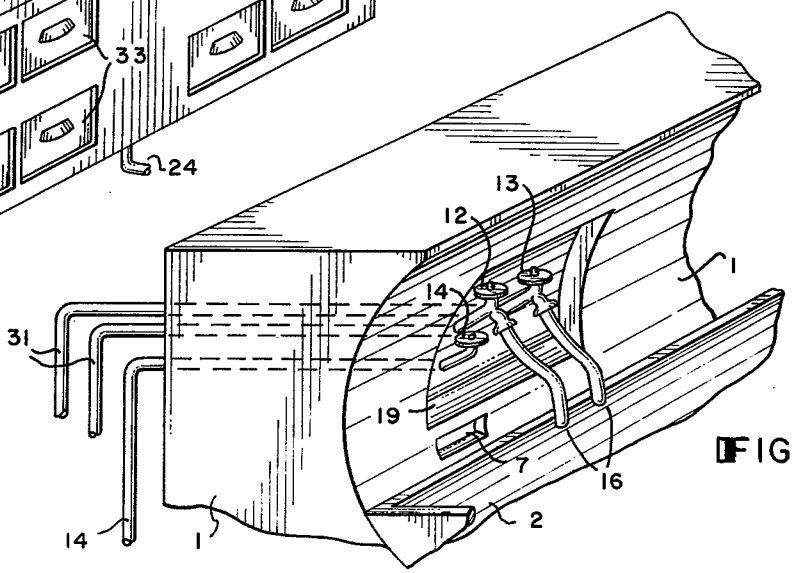
FIG. 6 depicts an embodiment of the present invention wherein a portable stool is provided and secured in position at the floor of the tub.

1 — Frame (support structure)
2 — Tub (a concave, water tight body substantially having the configuration of a half circular cylinder)
3 — Floor
4 — Support wheels for (3)
5 — Lockband for (3)
6 — Sliding door for hot and cold water spigots and drain control
7 — Soap holder
8 — Gear handle
9 — Gear assembly
10 — Drain
11 — Handle, push, pull
12 — Hot water spigot
13 — Cold water spigot
14 — Drain control
15 — Base fitting for (5) 12 and (20)
16 — Short hoses for (12) and (13)
17 — Screws for (15)
18 — Bolt to secure (2) via (20) and (21) with chain
19 — Box frame to hold (12), (13), (14), and (16)
20 — Lockband for (2)
21 — Lockholes for (20)
22 — Bearing track between outside edge of (2) and (1)
23 — Bearing track between outside edge of (2) and (3)
24 — Drain tube
25 — Portable stool
26 — Lock for assembly (8) and (9)
27 — Fitting for the attachment of (5) and (20) to (15)
28 — Handles inside of tub
29 — Hinges to raise floor for cleaning
30 — Holes for portable stool in floor (3)
31 — Hot and cold water pipes
32 — Nut, bolt, and washer for attachment of (27) to (15)
33 — Drawer for supplies 34 — legs of (25)
35 — Clips to hold (26)
36 — Floor design (raised configuration)
37 — Floor design (raised configuration)

DETAILED DESCRIPTION OF THE PREFERRED EMBODIMENTS

FIG. 1: This drawing shows the bathtub (2) with all the necessary components to be ready for the user. The tub (2) resting on the frame (1) is free to raise on the frame (1) by means of a bearing track (22), as by a push or pull, by a user, using the handles (11) or the handles (28), handles (28) being on the frame (1) and handles (11) on the wall edges of the tub (2). The tub (2) is also rotated from the outside by a gear assembly (9) and a gear handle (8) located on an end of the tub (2). Tub (2) rotates freely, and is held in a desired position by means of chain lock (26), which is attached to the chain on gear assembly (9) or by means of lockband (20), employing bolt (8) in the appropriate lockhole (21) of lockhand (20). This lockband (20) is attached to the frame (1) by screws (17) and base fitting (15), and by means of fitting (27) using nut and bolt (32). The floor (3) is supported by small bearings or wheels (4) in a bearing track (23) inside tub (2) in proximity to an end thereof and supported by lock bands (5) attached to the bottom of the floor (3) by screws (17). Lock bands (5) are also attached to the frame (1) by screws (17) and base fitting (15), and by means of fitting (27) using nut and bolt (32). The floor (3) also has a large drain hole (10) in the middle thereof (3). The tub (2) is advantageously at least 2° lower in the middle than on the ends for water drainage.

If the tub (2) is longer than four feet, the floor (3) should be anchored to frame (1) in the center thereof; also another set of track bearings (22) and (23) to be used should strengthen floor (3). Sliding door (6) affords access to hot and cold water spigots (12) and (13) and drain control (14). The door (6) should match the box frame (19), which holds the hot and cold water spigots and hoses (12), (13) and (16), and drain control (14). The latter is embedded in the frame (1) so the tub (2) can rotate over (19) and its contents.

The soap holder (7) is also embedded in the frame (1). Drain tube (24) is connected to the bottom of tub (2) and passes into frame (1). The bolt (18) for lock band (20) to fit holes (21) should have a chain on it so it will not be misplaced.

There are also hinges (29) on the floor (3) towards one end thereof, (3) so as not to hinder the users getting in or out of the tub (2). These hinges are for the purpose of raising the floor (3) for a thorough cleaning of the tub (2).

The legs of stool (25) are inserted into holes (30) in floor (3) and are held in position by nuts (34).

ASSEMBLY

With track bearings (22) and (23) properly positioned, tub (2) is set into track (22) so that the plane of the bottom of support structure (1) is parallel to the plane joining the remanent diameters of tub (2), which is substantially a half circular cylindrical body. Lock band (2) is then connected to frame (1).

One should insure that the support wheels (4) or bearings of the floor (3) are all in bearing track (23) communicates that these bearings or wheels (4) are working freely, and that the drain hole (10) matches up with the drain hole in the frame, and in the tub. Lock bands (5) are then connected on end to the edge of the curved position of the floor (3) near the end using fittings (27) and nut and bolt (32), and up to and on top of frame (1), using fitting (15) and screws (17).

The same fittings (15) and screws (17) are used to connect lock band (5) to floor (3). These lock bands (5) and (20) should be of fairly heavy material to hold their bend around or in the frame (1) and tub (2). At this time, sliding door (6) is installed in tub (2) to match box frame (19) in frame (2), affording access to the hot and cold water spigots (12) and (13) or drain control (14). Handles are affixed near the door (6) to rotate tub (2) around floor (3).

The gear assembly (9) should be installed using handle (8), and a lock chain pin (26) chained to frame (1) so as not to be misplaced. The assembly should be checked for freedom of movement and locking ability. The handle (8) should have a chain on it and a place to clip it on frame (1) when not in use. Next to be installed are hot and cold water spigots (12) and (13) and drain control (14), also small hoses (16) for spigots (12) and (13). Handles (28) are placed on edge of tub (2) to push or pull tub (2) around, or when locked, to use as a brace to get in and out of tub (2). (Note) Make sure tub (2) is locked for user to get in and out. Make sure all water is drained before moving tub (2) to entry or exit position. When not in use, lock tub (2).

What is claimed is:

1. A bathtub assembly which comprises the combination of:

(a) a rigid, polyhedral support structure having a top, bottom, front, back, and 2 side faces, the support structure having a channel, the configuration of which is substantially a half circular cylinder, the channel partially penetrating into the support structure from the intersection of the top and front faces thereof and extending along the length thereof from one side face to the other side face thereof;

(b) a concave, watertight body substantially having the configuration of a half circular cylinder, the body positioned within the channel so that the cylindrical surface of the body conforms to the cylindrical configuration of the channel, the cylindrical surface of the body being mounted on the support structure so that the body may rotate about the longitudinal axis thereof;

(c) releasable locking means for temporarily securing the body in (1) a first position defined by complete congruence of the body and the channel, or (2) a second position defined by parallelism of the plane of the bottom of the support structure with the plane joining the remanent diameters of the half circular cylindrical body;

(d) means for causing the body to rotate from said first position to said second position; and (e) means for the addition and removal of water from the body while said second position is occupied.

2. The assembly of claim 1, wherein the rotational mounting means for the body is a track bearing secured on the support structure at the bottom of the channel therein.

* * * * *